US006971133B2

(12) United States Patent
See

(10) Patent No.: US 6,971,133 B2
(45) Date of Patent: Dec. 6, 2005

(54) AIR MATTRESS APPARATUS

(76) Inventor: Ronald A. See, 9820 W. Calvin Rd., Hartstown, PA (US) 16131

( * ) Notice: Subject to any disclaimer, the term of this patent is extended or adjusted under 35 U.S.C. 154(b) by 0 days.

(21) Appl. No.: 10/841,196

(22) Filed: May 7, 2004

(65) Prior Publication Data

US 2004/0221394 A1 Nov. 11, 2004

Related U.S. Application Data

(60) Provisional application No. 60/468,836, filed on May 9, 2003.

(51) Int. Cl.[7] ..... A47C 27/10; B63B 35/73

(52) U.S. Cl. ..... 5/706; 5/710; 5/722; 5/738; 5/922; 441/129

(58) Field of Search ..... 5/706, 710, 711, 5/713, 644, 654, 655.3, 722, 737, 738, 922; 114/267; 441/129

(56) References Cited

U.S. PATENT DOCUMENTS

| | | | | | |
|---|---|---|---|---|---|
| 410,133 | A | * | 8/1889 | Blocher | 5/690 |
| 2,623,574 | A | * | 12/1952 | Damsch | 297/111 |
| 2,843,181 | A | * | 7/1958 | Paschen | 297/114 |
| 3,742,526 | A | * | 7/1973 | Lillard | 5/12.1 |
| 4,168,554 | A | * | 9/1979 | Hindes | 5/722 |
| 4,523,344 | A | * | 6/1985 | Stumpf et al. | 5/655.8 |
| 4,988,317 | A | | 1/1991 | Rubinsak et al. | |
| 5,020,175 | A | | 6/1991 | Kirkpatrick et al. | |
| 5,086,529 | A | * | 2/1992 | DeGroot | 5/710 |
| 5,117,775 | A | | 6/1992 | Northam et al. | |
| 5,136,741 | A | * | 8/1992 | Balonick et al. | 5/738 |
| 5,235,929 | A | | 8/1993 | Chester et al. | |
| D348,792 | S | * | 7/1994 | DeGroot | D6/604 |
| 5,398,354 | A | * | 3/1995 | Balonick et al. | 5/728 |
| 5,560,056 | A | * | 10/1996 | Tai | 5/120 |
| 5,658,178 | A | | 8/1997 | Varga | |
| 5,669,093 | A | * | 9/1997 | Ogle et al. | 5/720 |
| 5,761,756 | A | * | 6/1998 | Nowak et al. | 5/426 |
| 5,761,784 | A | * | 6/1998 | Ogle et al. | 5/720 |
| 6,775,868 | B1 | * | 8/2004 | Mileti et al. | 5/710 |
| 2005/0060803 | A1 | * | 3/2005 | Stewart et al. | 5/413 AM |
| 2005/0097674 | A1 | * | 5/2005 | Mileti | 5/710 |

OTHER PUBLICATIONS

Gershman, Maurice, M.D. "Self-Adhering Nylon Tapes." Journal of A.M.A. (vol. 168, No. 7) Oct. 18, 1958.*

* cited by examiner

*Primary Examiner*—Robert G. Santos

(57) ABSTRACT

An air mattress apparatus includes a first mattress section which contains a number of first flotation-bottle-reception chambers which are separated from each other by first stitches. First mattress section closure means enable access to inside the first flotation-bottle-reception chambers. First flotation bottles are received in the first flotation-bottle-reception chambers through the first mattress section closure means. A second mattress section is connected to the first mattress section. The second mattress section contains a number of second flotation-bottle-reception chambers which are separated from each other by second stitches. Second mattress section closure means enable access to inside the second flotation-bottle-reception chambers. Second flotation bottles are received in the second flotation-bottle-reception chambers through the second mattress section closure means. The air mattress apparatus can be used as a floating raft on water or as an air mattress on land.

8 Claims, 6 Drawing Sheets

10

14
14
30
30
36
24
2
12
28
42
5
18
32
34
20
20
34
38
26
3
3
2
24
28
12
42
32
18
26

FIG 3
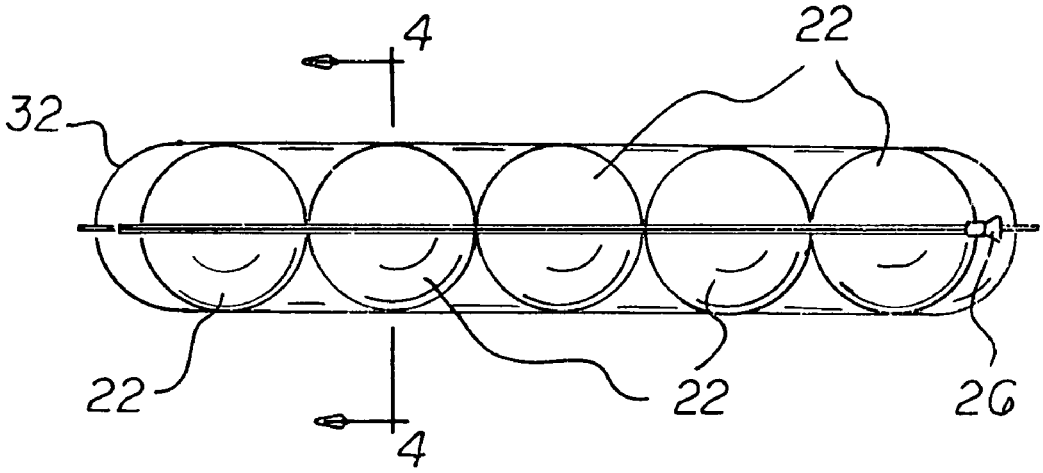
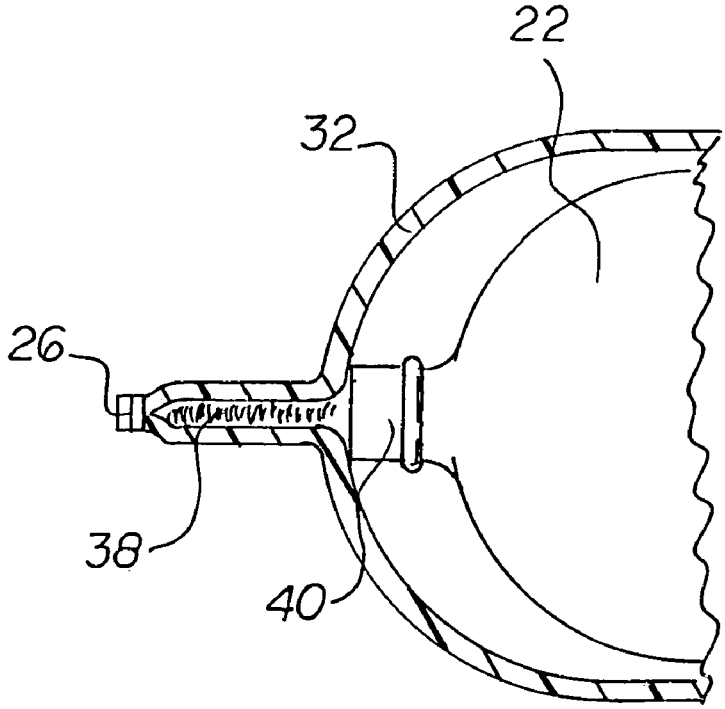
FIG 4

FIG 9
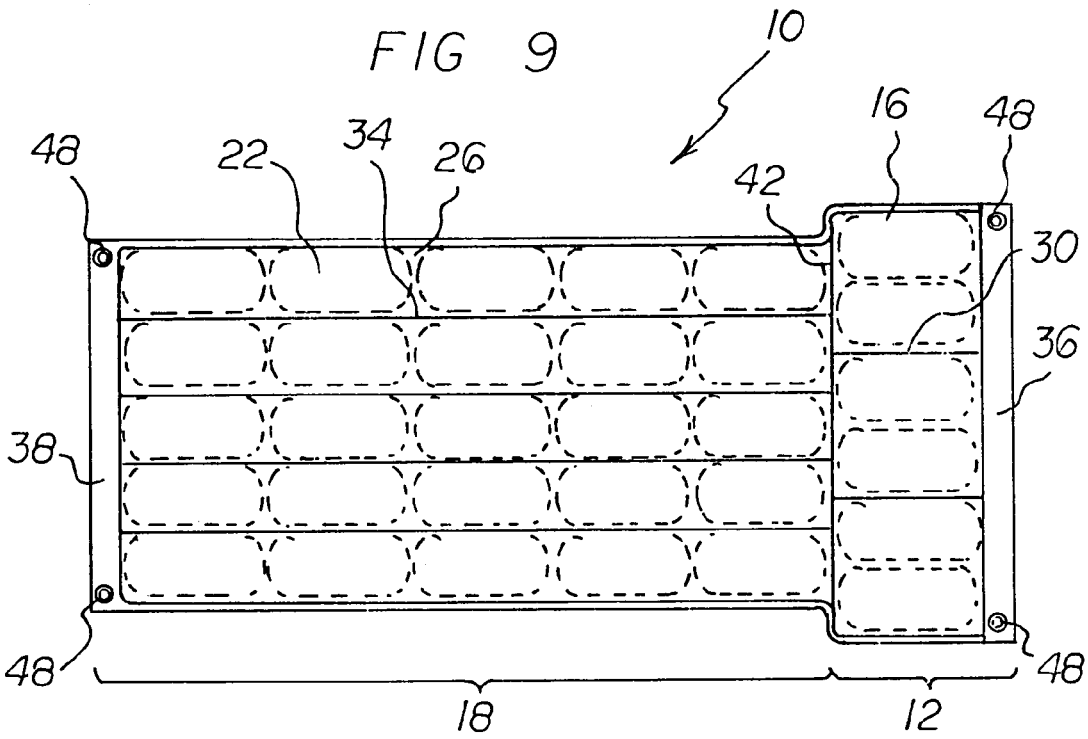
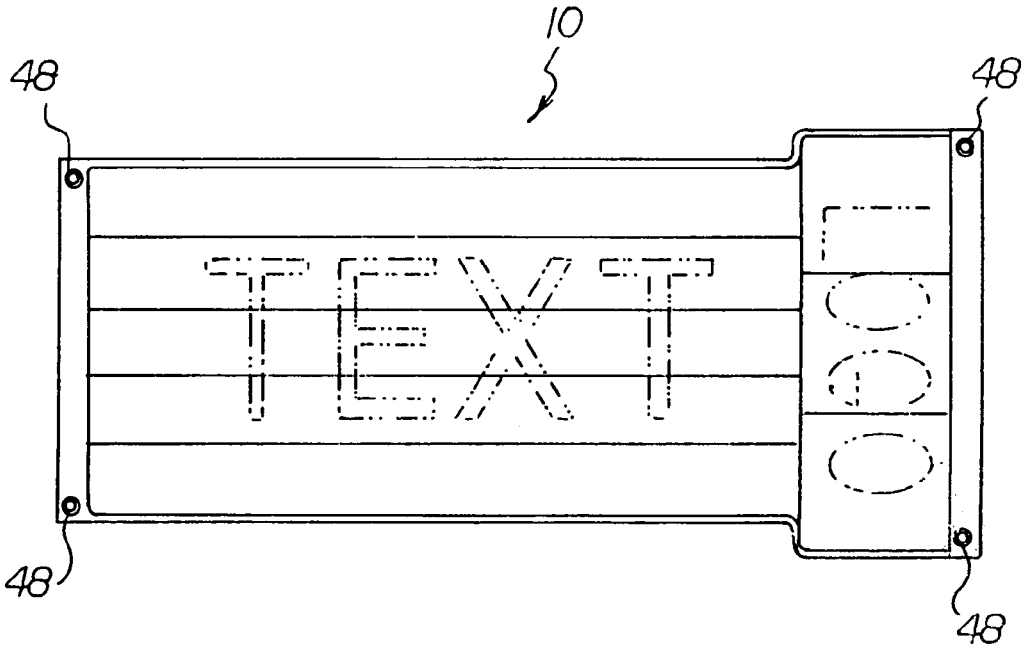
FIG 10

FIG 11
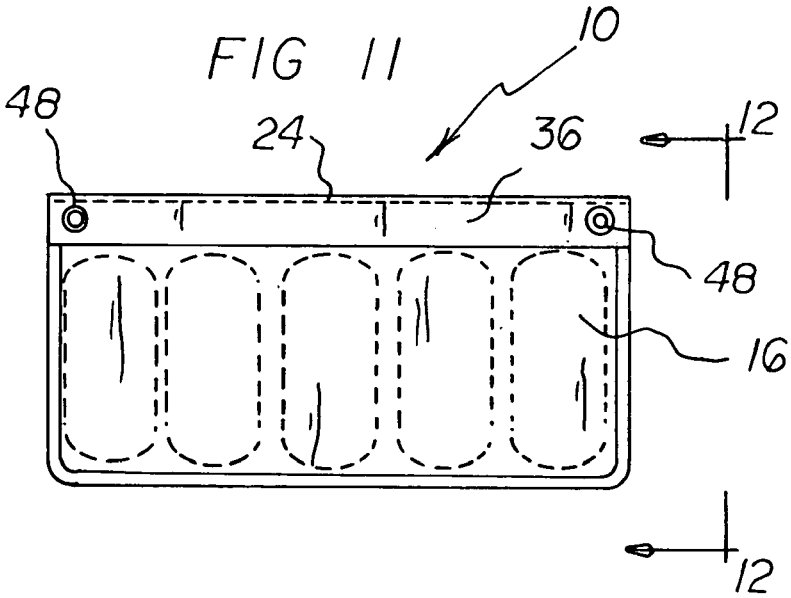
FIG 12
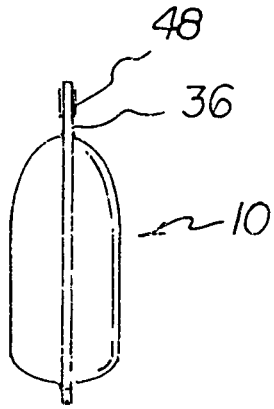
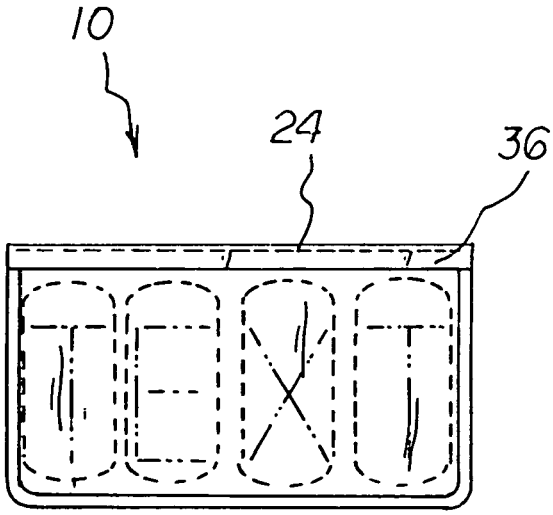
FIG 13

AIR MATTRESS APPARATUS

CROSS-REFERENCE TO RELATED APPLICATION

This application claims priority based upon my now abandoned, Provisional Application Ser. No. 60/468,836, filed May 9, 2003.

BACKGROUND OF THE INVENTION

1. Field of the Invention

The present invention relates generally to air mattresses, and, more particularly, to air mattresses that include empty plastic beverage containers as flotation units.

2. Description of the Prior Art

The use of air mattresses is well known. It is also known to use air mattresses that include a plurality of individual flotation units. More generally, throughout the years, a number of innovations have been developed relating to flotation devices that include a plurality of individual flotation units, and the following U.S. patents are representative of some of those innovations: U.S. Pat. Nos. 4,988,317, 5,020,175, 5,117,775, 5,235,929, and 5,658,178.

More specifically, U.S. Pat. No. 4,988,317 discloses a sectionalized pontoon float that includes a plurality of flotation units that fit onto the exterior surface of a support structure. Being on the exterior of the support structure, the flotation units could become dislodged from the support structure if the support structure were inverted. To avoid such a potential dislodging of a flotation unit from the exterior of a support structure, it would be desirable if a flotation device were provided in which flotation units are housed inside a support structure.

Each of U.S. Pat. No. 5,020,175, U.S. Pat. No. 5,117,775, and U.S. Pat. No. 5,658,178 discloses a multicompartment flotation device which employs a plurality of flotation units comprised of empty, recycled plastic containers. Even though plural plastic containers are employed, each respective multicompartment flotation device has essentially a single floatable section. That is, when a person would lie down upon the cushion, both the person's head and the person's torso would be supported by a single flotation device. In contrast, often when a person lies down in a bed, the person uses a mattress to support one's torso and often uses a separate pillow to support one's head. In this respect, it would be desirable if a flotation device were provided that included one flotation section for a person's torso and another flotation section for the person's head.

U.S. Pat. No. 5,235,929 may be of interest for its disclosure of a docking system that employs plural recycled plastic containers.

Still other features would be desirable in an air mattress apparatus. For example, so that a head-supporting section and a torso-supporting section can have a degree of independent movement, it would be desirable if a head-supporting section and a torso-supporting section were hinged together with a flexible hinge.

In addition, it would be desirable to provide a flotation device that included easy access to the inside of the device to facilitate removal and replacement of individual flotation units when desired.

To enable easy storage of a flotation device when not in use, it would be desirable if the flotation units in the device could be removed from a flexible exterior casing, and the flexible exterior casing could be folded into a small space for easy storage.

Thus, while the foregoing body of prior art indicates it to be well known to use flotation devices that employ air-filled flotation units, the prior art described above does not teach or suggest an air mattress apparatus which has the following combination of desirable features: (1) has flotation units which are housed inside a support structure; (2) includes one flotation section for a person's torso and another flotation section for the person's head; (3) provides a head-supporting section and a torso-supporting section which are hinged together with a flexible hinge; (4) provides easy access to the inside of the device to facilitate removal and replacement of individual flotation units when desired; and (5) provides a flexible exterior casing which can be folded into a small space for easy storage. The foregoing desired characteristics are provided by the unique air mattress apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an air mattress apparatus which includes a first mattress section which contains a number of first flotation-bottle-reception chambers. The first flotation-bottle-reception chambers are separated from each other by first chamber separation means. First mattress section closure means enable access to inside the first flotation-bottle-reception chambers. First flotation bottles are received in the first flotation-bottle-reception chambers through the first mattress section closure means. A second mattress section is connected to the first mattress section. The second mattress section contains a number of second flotation-bottle-reception chambers. The second flotation-bottle-reception chambers are separated from each other by second chamber separation means. Second mattress section closure means enable access to inside the second flotation-bottle-reception chambers. Second flotation bottles are received in the second flotation-bottle-reception chambers through the second mattress section closure means.

The invention can be used in a number of ways. First, an air mattress apparatus can be used as a flotation device on water. To do so, each of the respective bottles is empty, that is filled with air, and each respective bottle is sealed tightly with a bottle cap to prevent air from leaking out from the bottle. In this respect, the air mattress apparatus of the invention can be used as a floating raft in the water.

Second, the air mattress apparatus of the invention can be used as an auxiliary mattress on the floor, on a bed, on a chair, on a couch, or on the ground, or in a boat, among other uses.

Preferably, the first flotation-bottle-reception chambers are oriented parallel to each other, and the second flotation-bottle-reception chambers are oriented parallel to each other and to the first flotation-bottle-reception chambers.

Preferably, the first mattress section is in a form of a pillow section to support a person's head, and the second mattress section is in a form of a torso and leg supporting section to support the person's torso and legs.

A section-to-section hinge is connected between the first mattress section and the second mattress section. Preferably, the section-to-section hinge is in form of a fabric hinge.

Preferably, the first flotation bottles and the second flotation bottles are comprised of recycled plastic bottles. Preferably, the first flotation bottles and the second flotation bottles are comprised of flexible-walled plastic bottles. The recycled plastic bottles are beverage bottles. Preferably, the recycled plastic beverage bottles are 1-liter bottles, 2-liter bottles, or any other plastic reusable containers.

Preferably, the first mattress section closure means include a first zipper, and the second mattress section closure means include a second zipper. Preferably, the first zipper and the second zipper are located at opposite ends of the apparatus.

Preferably, the first mattress section closure means further include first complementary hook and loop strips adjacent to the first zipper, and the second mattress section closure means further include second complementary hook and loop strips adjacent to the second zipper.

Preferably, the first mattress section includes a quantity of first flexible sheet material; the first chamber separation means include first stitches; the second mattress section includes a quantity of second flexible sheet material; and the second chamber separation means include second stitches.

In accordance with another aspect of the invention, an air mattress casing is provided which includes a first mattress section which contains a number of first flotation-bottle-reception chambers, wherein the first flotation-bottle-reception chambers are separated from each other by first chamber separation means. First mattress section closure means are provided for enabling access to inside the first flotation-bottle-reception chambers. A second mattress section is connected to the first mattress section, wherein the second mattress section contains a number of second flotation-bottle-reception chambers, and wherein the second flotation-bottle-reception chambers are separated from each other by second chamber separation means. Second mattress section closure means are provided for enabling access to inside the second flotation-bottle-reception chambers. A section-to-section hinge is connected between the first mattress section and the second mattress section.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air mattress apparatus which has all of the advantages of the prior art and none of the disadvantages.

It is another object of the present invention to provide a new and improved air mattress apparatus which may be easily and efficiently manufactured and marketed.

It is a further object of the present invention to provide a new and improved air mattress apparatus which is of durable and reliable construction.

An even further object of the present invention is to provide a new and improved air mattress apparatus which is susceptible of a low cost of manufacture with regard to both materials and labor, and which accordingly is then susceptible of low prices of sale to the consuming public, thereby making such air mattress apparatus available to the buying public.

Still yet a further object of the present invention is to provide a new and improved air mattress apparatus which has flotation units which are housed inside a support structure.

Still another object of the present invention is to provide a new and improved air mattress apparatus that includes one flotation section for a person's torso and another flotation section for the person's head.

Yet another object of the present invention is to provide a new and improved air mattress apparatus which provides a head-supporting section and a torso-supporting section which are hinged together with a flexible hinge.

Even another object of the present invention is to provide a new and improved air mattress apparatus that provides easy access to the inside of the device to facilitate removal and replacement of individual flotation units when desired.

Still a further object of the present invention is to provide a new and improved air mattress apparatus which provides a flexible exterior casing which can be folded into a small space for easy storage.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an end view of the embodiment of the air mattress apparatus of FIG. 1 taken along line 3—3 thereof.

FIG. 4 is an enlarged partial cross-sectional view of the embodiment of the invention shown in FIG. 3 taken along line 4—4 thereof.

FIG. 9 is a plan view showing a fourth, alternatively preferred embodiment of the air mattress apparatus of the invention.

FIG. 10 is a plan view of the embodiment of FIG. 9 schematically showing advertising indicia or the like emplaced thereon.

FIG. 11 is a plan view showing a fifth, alternatively preferred embodiment of the air mattress apparatus of the invention.

FIG. 12 is a side view taken along line 12—12 of the embodiment of FIG. 11.

FIG. 13 is a plan view of the embodiment of FIGS. 11 and 12 schematically showing advertising indicia or the like emplaced thereon.

DESCRIPTION OF THE PREFERRED EMBODIMENT

Figures 1, 2:
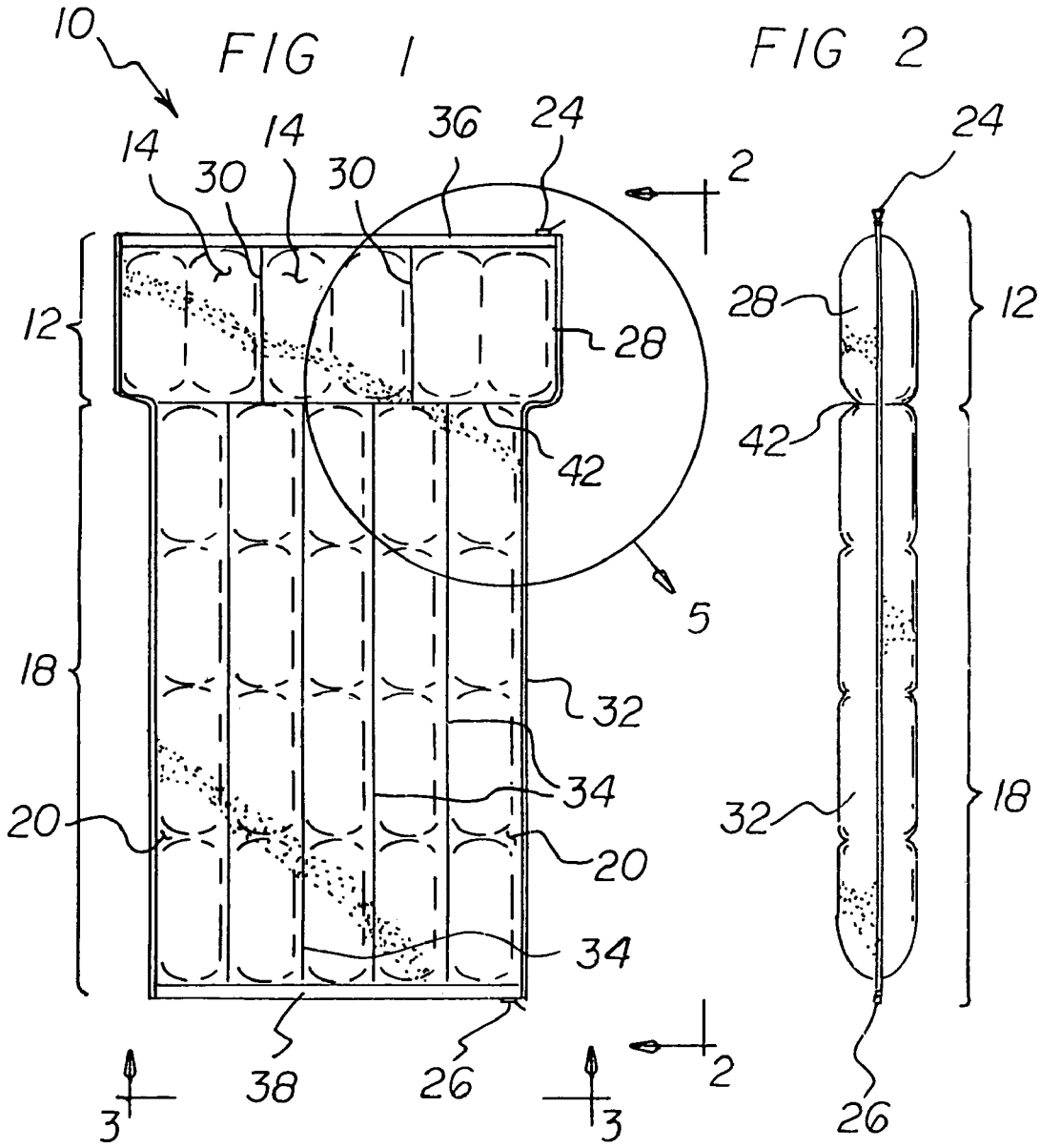
FIG. 1 is a plan view showing a first embodiment of the air mattress apparatus of the invention.
FIG. 2 is a side view of the embodiment of the air mattress apparatus shown in FIG. 1 taken along line 2—2 of FIG. 1.
Figure 5:
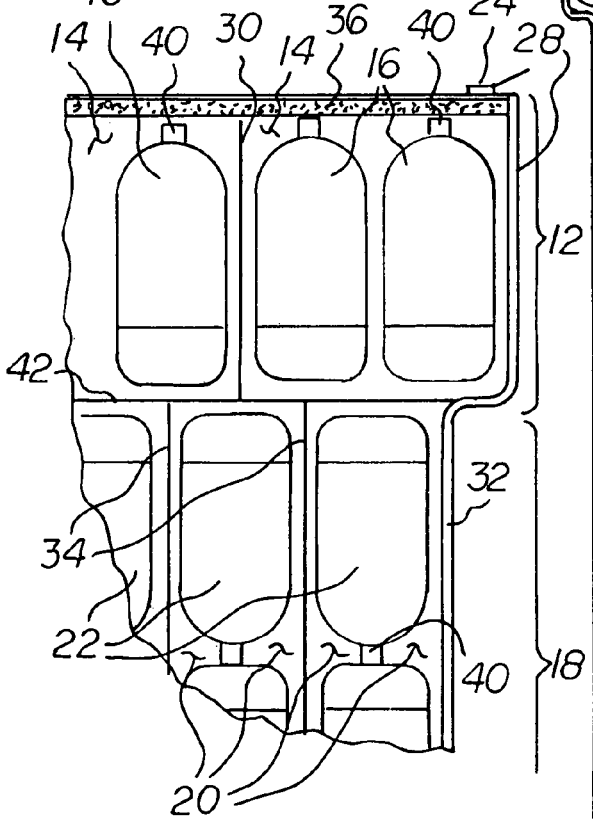
FIG. 5 is a partially broken away view of the embodiment of the invention shown in circled region 5 of FIG. 1.

With reference to the drawings, a new and improved air mattress apparatus embodying the principles and concepts of the present invention will be described.

Turning to FIGS. 1–5, there is shown a first embodiment of the air mattress apparatus of the invention generally designated by reference numeral 10. In the first embodiment, air mattress apparatus 10 includes a first mattress section 12 which contains a number of first flotation-bottle-reception chambers 14. The first flotation-bottle-reception chambers 14 are separated from each 10 other by first chamber separation means. First mattress section closure means enable access to inside the first flotation-bottle-reception chambers 14. First flotation bottles 16 are received in the first flotation-bottle-reception chambers 14 through the first mattress section closure means.

A second mattress section 18 is connected to the first mattress section 12. The second mattress section 18 contains a number of second flotation-bottle-reception chambers 20. The second flotation-bottle-reception chambers 20 are separated from each other by second chamber separation means. Second mattress section closure means enable access to inside the second flotation-bottle-reception chambers 20. Second flotation bottles 22 are received in the second flotation-bottle-reception chambers 20 through the second mattress section closure means.

Preferably, the first flotation-bottle-reception chambers 14 are oriented parallel to each other, and the second flotation-bottle-reception chambers 20 are oriented parallel to each other and to the first flotation-bottle-reception chambers 14.

Preferably, the first mattress section 12 is in a form of a pillow section to support a person's head, and the second mattress section 18 is in a form of a torso and leg supporting section to support the person's torso and legs.

A section-to-section hinge 42 is connected between the first mattress section 12 and the second mattress section 18. Preferably, the section-to-section hinge 42 is in form of a fabric hinge 42.

Preferably, the first flotation bottles 16 and the second flotation bottles 22 are comprised of recycled plastic bottles. Preferably, the first flotation bottles 16 and the second flotation bottles 22 are comprised of flexible-walled plastic bottles. The recycled plastic bottles are beverage bottles. Preferably, the recycled plastic beverage bottles are 1-liter or 2-liter bottles which are widely commercially available.

Preferably, the first mattress section closure means include a first zipper 24, and the second mattress section closure means include a second zipper 26. Preferably, the first zipper 24 and the second zipper 26 are located at opposite ends of the apparatus. The first zipper 24 and the second zipper 26 can be made from non-rusting nylon material.

Preferably, the first mattress section closure means further include first complementary hook and loop strips 36 adjacent to the first zipper 24, and the second mattress section closure means further include second complementary hook and loop strips 38 adjacent to the second zipper 26. The first complementary hook and loop strips 36 and the second complementary hook and loop strips 38 can be made from well known VELCRO™ material.

The first mattress section 12 includes a quantity of first flexible sheet material 28; the first chamber separation means include first stitches 30; the second mattress section 18 includes a quantity of second flexible sheet material 32; and the second chamber separation means include second stitches 34. Instead of stitches, the foregoing separation seams may optionally be produced by suitably heat-sealing the opposed sheets of the air mattress together as is well known in the art.

To use any of the illustrated embodiments of the invention, the first zipper 24 is unzipped. The first complementary hook and loop strips 36 are separated from each other, and the first flotation bottles 16 are placed in the first flotation-bottle-reception chambers 14. Then, the first complementary hook and loop strips 36 are meshed together again, and the first zipper 24 is zipped shut. Similarly, the second zipper 26 is unzipped. The second complementary hook and loop strips 38 are separated from each other, and the second flotation bottles 22 are placed in the second flotation-bottle-reception chambers 20. Then, the second complementary hook and loop strips 38 are meshed together again, and the second zipper 26 is zipped shut.

Preferably, the first stitches 30 and the second stitches 34 are double stitched. Preferably, the first flexible sheet material 28 and the second flexible sheet material 32 are made from light weight, water resistant canvas or the type of material used in making rainwear. Alternatively, the first flexible sheet material 28 and the second flexible sheet material 32 may be made of suitable water impervious plastic material heat-sealed together along their common confronting peripheral side edges.

The embodiment of the invention shown in FIGS. 1–5 can be regarded as a child size and can be 30 inches by 60 inches in width and length respectively. The child size air mattress apparatus 10 of the invention can hold 26 two liter recycled beverage bottles. As shown in the drawings, with the first embodiment of the invention, six first flotation bottles 16 are contained in three first flotation-bottle-reception chambers 14 in the first mattress section 12, and twenty second flotation bottles 22 are contained in five second flotation-bottle-reception chambers 20 in the second mattress section 18. In the first mattress section 12, two first flotation bottles 16 are in each first flotation-bottle-reception chamber 14, and four second flotation bottles 22 are contained in each of five second flotation-bottle-reception chambers 20.

Figure 6:
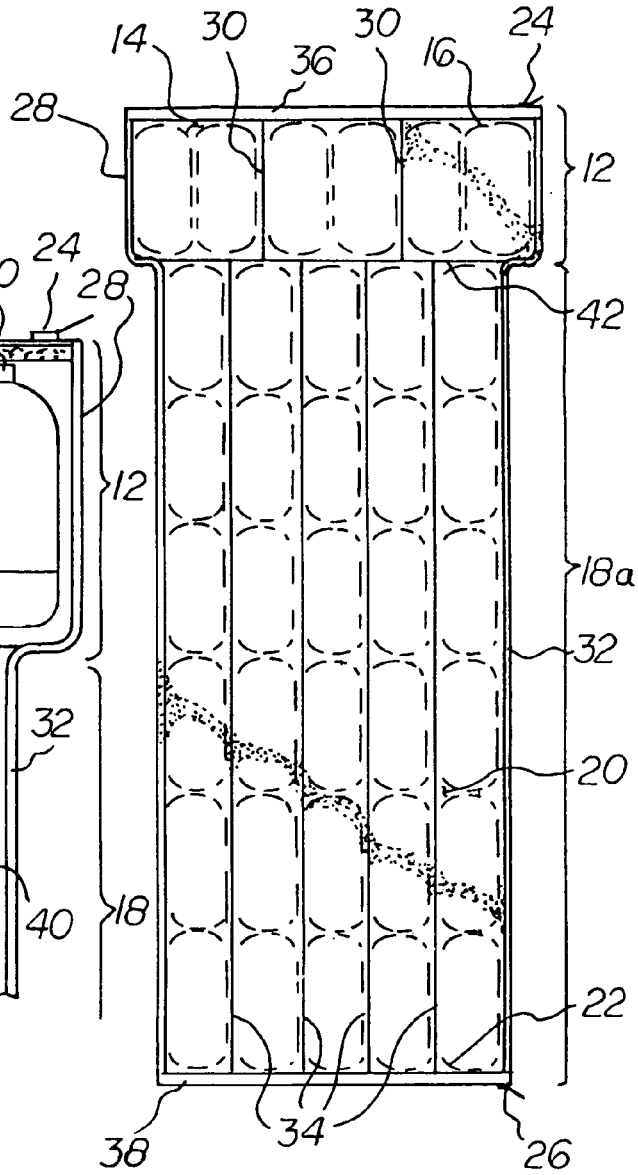
FIG. 6 is a plan view showing a second embodiment of the air mattress apparatus of the invention.

The embodiment of the invention shown in FIG. 6 can be regarded as an adult size and is longer than the child size. In this respect, alternate second mattress section 18*a* is longer than the second mattress section 18 shown in the first embodiment of the invention. In addition. Each of five second flotation-bottle-reception chambers 20 contains six second flotation bottles 22. With the second embodiment of the invention, the first mattress section 12 still contains six first flotation bottles 16 in three first flotation-bottle-reception chambers 14. Therefore, the second air mattress apparatus embodiment of the invention contains a total of thirty-six flotation bottles.

Figure 7:
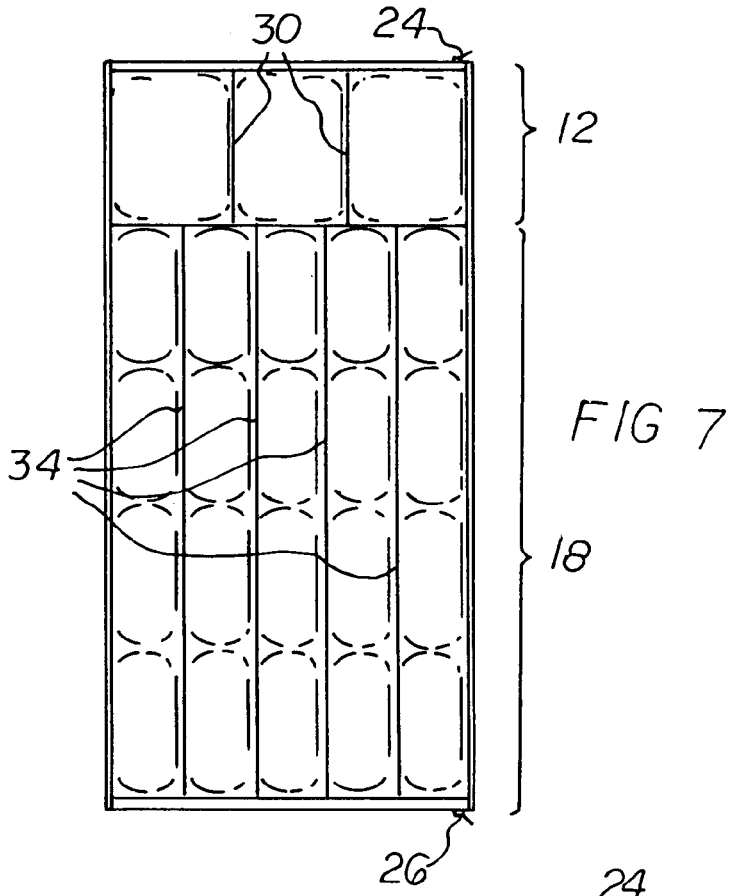
FIG. 7 is a plan view showing a third embodiment of the air mattress apparatus of the invention.
Figure 8:
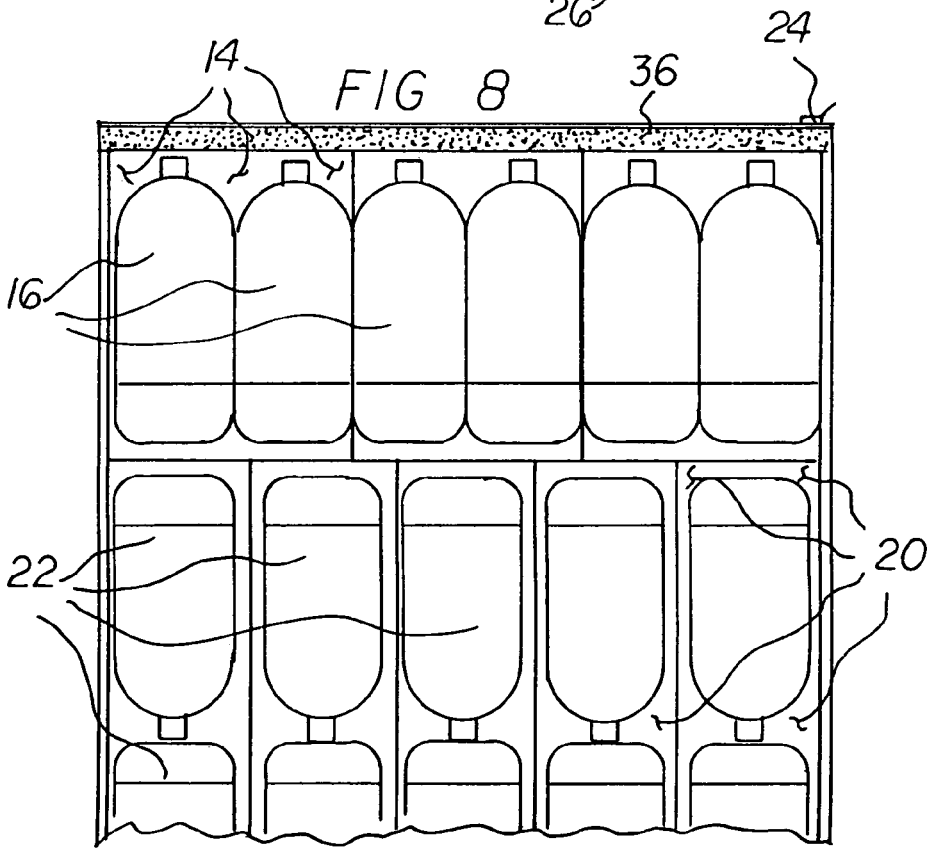
FIG. 8 is a partially broken away view of the embodiment of the air mattress apparatus shown in FIG. 7.

In the third embodiment of the invention depicted in FIGS. 7 and 8, the first mattress section 12 and the second mattress section 18 have the same transverse extent substantially as illustrated thereby to provide an air mattress 10 according to the invention of substantially rectangular shape substantially as illustrated.

Any of the embodiments of the invention can be used in a number of ways. First, an air mattress apparatus 10 can be used as a flotation device on water. To do so, each of the respective bottles is empty, that is filled with air, and each respective bottle is sealed tightly with a bottle cap 40 to prevent air from leaking out from the bottle. In this respect, the air mattress apparatus 10 of the invention can be used as a floating raft in the water.

Second, the air mattress apparatus 10 of the invention can be used as an auxiliary mattress on the floor, on a bed, on a chair, on a couch, or on the ground, or in a boat, among other uses.

When the air mattress apparatus 10 is no longer needed to be deployed, the respective flotation bottles can be removed from the respective mattress sections, and the flotation bottles can be placed in storage. Moreover, once the bottles have been removed, the first mattress section 12 and the second mattress section 18 can be folded up into a relatively small package for storage.

The components of the air mattress apparatus of the invention can be made from inexpensive and durable plastic and fabric materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved air mattress apparatus that is low in cost, relatively simple in design and operation, and which advantageously has flotation units which are housed inside a support structure. With the invention, an air mattress apparatus is provided which includes one flotation section for a person's torso and another flotation section for the person's head. With the invention, an air mattress apparatus provides a head-supporting section and a torso-supporting section which are hinged together with a flexible hinge. With the invention, an air mattress apparatus provides easy access to the inside of the device to facilitate removal and replacement of individual flotation units when desired. With the invention, an air mattress apparatus provides a flexible exterior casing which can be folded into a small space for easy storage.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

For example, as shown in FIGS. 9 and 10, the size of the air mattress apparatus may be varied to suit individual requirements. Thus, in FIGS. 9 and 10, there is shown an intermediate-sized air mattress apparatus wherein each of the five second flotation-bottle-reception chambers 20 contains five second flotation bottles 22. With this fourth alternatively preferred embodiment of the invention, the first mattress section 12 still contains six first flotation bottles 16 in three first flotation-bottle-reception chambers 14. Therefore, the fourth air mattress apparatus embodiment of the invention may contain a total of thirty-one flotation bottles.

In addition, as substantially shown, any embodiment of the present invention may advantageously include grommets, brass eyelets, or the like, indicated by reference sign 48, suitably affixed in the four corners of the mattress and passing commonly through strips 36, 38, respectively, for facilitating hanging or storage of the air mattress on hooks or nails in a wall surface. Alternatively, the grommets 48 may conveniently be used to securely attach a rope or ropes to the air mattress for tieing the air mattress to a dock or similar structure as it floats on the surface of the water.

Still further, either or both side surfaces of the air mattress of the invention may be adorned with advertising text, logos, decorative graphics, or other indicia, applied conventionally as by silk-screening technique well known in the art, and as schematically indicated in FIG. 10 by the broken-line words "TEXT" and "LOGO."

Yet still further, a substantially smaller version of the air mattress of the present invention may be provided comprising a single row of bottles, say, for example, five in number, substantially as depicted in FIGS. 11–13. In this fifth alternatively preferred embodiment of the present invention, the air mattress may be used as "floatable" boat seat, camp seat, or pillow. Here again, as schematically indicated ion FIG. 13 by the broken-line word "TEXT," advertising text, logos, decorative graphics, or the like may be placed on either or both sides of the air mattress, and grommets 48 are affixed in the opposite corners thereof (FIG. 11). As in the prior embodiments, the "pillow" or "seat" of FIGS. 11–13 may be fabricated by suitably stitching together opposed sheets of flexible, tough, water-impervious material, or optionally using suitable plastic material, and heat-sealing the sheets together as appropriate.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed:

1. An air mattress apparatus, comprising:

a first mattress section which contains a number of first flotation-bottle-reception chambers, wherein said first flotation-bottle-reception chambers are separated from each other by first chamber separation means, first mattress section closure means enabling access to inside said first flotation-bottle-reception chambers, first flotation bottles received in said first flotation-bottle-reception chambers through said first mattress section closure means, a second mattress section connected to said first mattress section, wherein said second mattress section contains a number of second flotation-bottle-reception chambers, wherein said second flotation-bottle-reception chambers are separated from each other by second chamber separation means, second mattress section closure means enabling access to inside said second flotation-bottle-reception chambers, second flotation bottles received in said second flotation-bottle-reception chambers through said second mattress section closure means, and a section-to-section hinge connected between said first mattress section and said second mattress section, wherein:

said first mattress section is in a form of a pillow section to support a person's head, and said second mattress section is in a form of a torso and leg supporting section to support the person's torso and legs, and wherein:

said first mattress section closure means include a first zipper, and said second mattress section closure means include a second zipper, said first mattress section closure means further include first complementary hook and loop strips adjacent to said first zipper, and said second mattress section closure means further include second complementary hook and loop strips adjacent to said second zipper.

2. The apparatus of claim 1 wherein said first mattress section closure means and said second mattress section closure means are located at opposite ends of said apparatus.

3. The apparatus of claim 1 wherein: said first flotation-bottle-reception chambers are oriented parallel to each other, and said second flotation-bottle-reception chambers are oriented parallel to each other and to said first floatation-bottle-reception chambers.

4. The apparatus of claim 1 wherein said section-to-section hinge is in form of a fabric hinge.

5. The apparatus of claim 1 wherein said first flotation bottles and said second flotation bottles are comprised of recycled plastic bottles.

6. The apparatus of claim 5 wherein said recycled plastic bottles are beverage bottles.

7. The apparatus of claim 1 wherein said first flotation bottles and said second flotation bottles are comprised of flexible-walled plastic bottles.

8. The apparatus of claim 1 wherein:

said first mattress section includes a quantity of first flexible sheet material, said first chamber separation means include first stitches, said second mattress section includes a quantity of second flexible sheet material, and said second chamber separation means include second stitches.

* * * * *